US012330827B2

(12) United States Patent
Fox et al.

(10) Patent No.: US 12,330,827 B2
(45) Date of Patent: Jun. 17, 2025

(54) CASE-HANDLING SYSTEM WITH FLAP OPENERS

(71) Applicant: Signode Industrial Group LLC, Tampa, FL (US)

(72) Inventors: Bryce J. Fox, Honesdale, PA (US); William J. Menta, West Wyoming, PA (US)

(73) Assignee: SIGNODE INDUSTRIAL GROUP LLC, Tampa, FL (US)

( * ) Notice: Subject to any disclaimer, the term of this patent is extended or adjusted under 35 U.S.C. 154(b) by 0 days.

(21) Appl. No.: 18/063,155

(22) Filed: Dec. 8, 2022

(65) Prior Publication Data

US 2023/0192337 A1 Jun. 22, 2023

Related U.S. Application Data

(60) Provisional application No. 63/265,630, filed on Dec. 17, 2021.

(51) Int. Cl.

| | |
|---|---|
| ***B65B 43/39*** | (2006.01) |
| ***B65B 43/26*** | (2006.01) |
| ***B65B 43/52*** | (2006.01) |

(52) U.S. Cl.
CPC ..... *B65B 43/39* (2013.01); *B65B 43/265* (2013.01); *B65B 43/52* (2013.01)

(58) Field of Classification Search
CPC ..... B65B 43/39; B65B 43/265; B65B 43/52; B65B 43/38; B65B 7/20–26
See application file for complete search history.

(56) References Cited

U.S. PATENT DOCUMENTS

| | | | | |
|---|---|---|---|---|
| 2,982,076 | A | 5/1961 | Shelton | |
| 3,296,769 | A | 1/1967 | Patton | |
| 3,452,653 | A * | 7/1969 | Berney | B65B 43/39 493/18 |
| 3,662,516 | A * | 5/1972 | Wiseman | B65B 43/39 53/76 |
| 4,010,597 | A | 3/1977 | Nelson | |
| RE30,921 | E | 5/1982 | McDowell | |
| 6,070,396 | A | 6/2000 | Rinaldi et al. | |
| 7,278,248 | B2 | 10/2007 | Vinh | |
| 7,331,916 | B2 | 2/2008 | Fox | |

(Continued)

FOREIGN PATENT DOCUMENTS

| | | | |
|---|---|---|---|
| CN | 111674645 | A | 9/2020 |
| CN | 112193513 | A | 1/2021 |

(Continued)

OTHER PUBLICATIONS

"Extended European Search Report", from corresponding European Patent Application No. 22212456.2, Jun. 12, 2023.

(Continued)

*Primary Examiner* — Anna K Kinsaul
*Assistant Examiner* — Himchan Song
(74) *Attorney, Agent, or Firm* — Neal, Gerber & Eisenberg LLP

(57) ABSTRACT

Various embodiments of the present disclosure provide a case-handling system including movable flap openers positionable relative to a case and operable to fold the upper major flaps of the case outwardly before the upper minor flaps of the case are folded inwardly and closed.

13 Claims, 9 Drawing Sheets

(56) References Cited

U.S. PATENT DOCUMENTS

| | | | | |
|---|---|---|---|---|
| 7,571,588 | B2 | 8/2009 | Sambuca et al. | |
| 9,452,852 | B2 | 9/2016 | Sambuca | |
| 10,597,179 | B2 | 3/2020 | Menta et al. | |
| 11,273,939 | B2 | 3/2022 | Fox | |
| 11,358,744 | B2 | 6/2022 | Menta et al. | |
| 11,492,163 | B2 | 11/2022 | Menta et al. | |
| 2018/0141700 | A1* | 5/2018 | Ridgeway | B65B 49/08 |
| 2019/0193886 | A1* | 6/2019 | Brizzi | B65B 59/005 |
| 2019/0283914 | A1 | 9/2019 | Menta et al. | |
| 2019/0283916 | A1 | 9/2019 | Menta et al. | |
| 2019/0329515 | A1* | 10/2019 | Davis | B65B 51/02 |
| 2020/0039671 | A1 | 2/2020 | Fox | |
| 2020/0148400 | A1 | 5/2020 | Menta et al. | |
| 2021/0009294 | A1 | 1/2021 | Menta et al. | |
| 2021/0300611 | A1 | 9/2021 | Menta | |
| 2022/0089308 | A1 | 3/2022 | Monti | |
| 2023/0192337 | A1* | 6/2023 | Fox | B65B 43/38<br>53/382.1 |

FOREIGN PATENT DOCUMENTS

| | | | |
|---|---|---|---|
| CN | 213677427 | U | 7/2021 |
| DE | 1196567 | B | 7/1965 |
| KR | 100596371 | B1 | 7/2006 |
| WO | 2022217203 | A1 | 10/2022 |

OTHER PUBLICATIONS

"Four Flap Opener", Hamrick Manufacturing, found at www.youtube.com/watch?v=UT2FhGHhpok, available before the priority date of this patent application.

* cited by examiner

CASE-HANDLING SYSTEM WITH FLAP OPENERS

PRIORITY

This application claims priority to and the benefit of U.S. Provisional Patent Application No. 63/265,630, filed Dec. 17, 2021, the entire contents of which is incorporated hereby by reference.

FIELD

The present disclosure relates to case-handling systems, and more particularly to case-handling systems with flap openers that open the upper major flaps of a case.

BACKGROUND

Every day, companies around the world pack millions of items in cases (such as cases formed from corrugated) to prepare them for shipping. FIGS. 1A and 1B show an example prior art case C. The case C includes a first major side wall SW1, a second major side wall SW2, a first minor side wall EW1, a second minor side wall EW2, a first upper major flap UMa1, a second upper major flap UMa2, a first upper minor flap UMi1, a second upper minor flap UMi2, a first lower major flap LMa1, a second lower major flap LMa2, a first lower minor flap LMi1 (numbered for ease of reference but not shown), and a second lower minor flap LMi2 (numbered for ease of reference but not shown).

The first and second minor side walls EW1 and EW2 are integrally connected to opposing side edges, respectfully, of the first major side wall SW1 and are separated from the first major side wall SW1 via vertical fold lines (such as creases or scores) F1 and F2, respectively. The first and second minor side walls EW1 and EW2 are also integrally connected to opposing side edges, respectfully, of the second major side wall SW2 and are separated from the second major side wall SW2 via vertical fold lines F3 and F4, respectively. Accordingly, the first and second minor side walls EW1 and EW2 and the first and second major side walls SW1 and SW2 are all integrally connected.

The first upper and lower major flaps UMa1 and LMa1 are integrally connected to the upper and lower edges, respectfully, of the first major side wall SW1 and separated from the first major side wall SW1 via horizontal fold lines F5 and F6, respectively. The second upper and lower major flaps UMa2 and LMa2 are integrally connected to the upper and lower edges, respectfully, of the second major side wall SW2 and separated from the second major side wall SW2 via horizontal fold lines F7 and F8, respectively. The first upper and lower minor flaps UMi1 and LMi1 are integrally connected to the upper and lower edges, respectfully, of the first minor side wall EW1 and separated from the first minor side wall EW1 via horizontal fold lines F9 and F10 (numbered for ease of reference but not shown), respectively. The second upper and lower minor flaps UMi2 and LMi2 are integrally connected to the upper and lower edges, respectfully, of the second minor side wall EW2 and separated from the second minor side wall EW2 via horizontal fold lines F11 and F12, respectively.

FIG. 1A shows the case C in a partially closed configuration in which the major and minor side walls are generally perpendicular to one another, the lower major and minor flaps are closed, and the upper major and minor flaps are open. More specifically, the lower minor flaps LMi1 and LMi2 are folded along the fold lines F10 and F12, respectively, such that they extend into the cavity formed by the major and minor side walls SW1, SW2, EW1, and EW2 and are generally perpendicular to the major and minor side walls, and the lower major flaps LMa1 and LMa2 are folded along the fold lines F6 and F8, respectively, such that they cover the lower minor flaps LMi1 and LMi2 and are generally perpendicular to the major and minor side walls. Since the upper major and minor flaps are open, the upper end of case C is open and ready to receive items (and if necessary, dunnage) before the upper major and minor flaps are closed (i.e., folded and taped shut).

To close the top of the case after product (and, if needed, dunnage) is loaded in the case C, first, the upper minor flaps UMi1 and UMi2 are folded inwardly (i.e., toward one another) along their respective fold lines F9 and F11 and then the upper major flaps UMa1 and UMa2 are folded inwardly (i.e., toward one another) along their respective fold lines F5 and F7. After being closed, the upper major flaps UMa1 and UMa2 are sealed via pressure-sensitive tape. Before the upper minor flaps are folded inwardly, it's important that the upper major flaps first be folded outwardly to avoid interfering with the folding of the upper minor flaps. If the upper major flaps are folded inwardly at this point, such as is shown in FIG. 1B, they must be folded back outwardly to make room for the upper minor flaps to be folded inwardly. If not, the upper major flaps can block the upper minor flaps from being folded inwardly, which can result in deformation or destruction of the case, the case jamming the case-handling system, and inadequate closing and sealing, ultimately reducing the integrity of the case (and the product inside).

SUMMARY

Various embodiments of the present disclosure provide a case-handling system including movable flap openers positionable relative to a case and operable to fold the upper major flaps of the case outwardly before the upper minor flaps of the case are folded inwardly and closed.

Various embodiments of the present disclosure provide a case-handling system including a conveyor, a rotatable first flap opener comprising a first flap-engaging finger, a rotatable second flap opener comprising a second flap-engaging finger and spaced apart from the first flap opener, one or more actuators operably connected to the first and second flap openers and configured to rotate the first and second flap openers in opposing rotational directions, and a controller operably connected to the conveyor to drive the conveyor and to the one or more actuators to rotate the first and second flap openers. The first and second flap openers are positionable such that, when a case having first and second upper major flaps and first and second upper minor flaps is conveyed by the conveyor between and past the first and second flap openers: the first flap opener engages an inner surface of the first upper major flap to fold the first upper major flap outwardly, and the second flap opener engages an inner surface of the second upper major flap to fold the second upper major flap outwardly.

Various embodiments of the present disclosure provide a method of operating a case-handling system. The method includes when a case having open first and second upper major flaps and first and second upper minor flaps is at a flap opening position: causing a first flap opener to engage an inner surface of the first upper major flap to fold the first upper major flap outwardly, and causing a second flap opener to engage an inner surface of the second upper major flap to fold the second upper major flap outwardly.

DETAILED DESCRIPTION

Figure 1A:
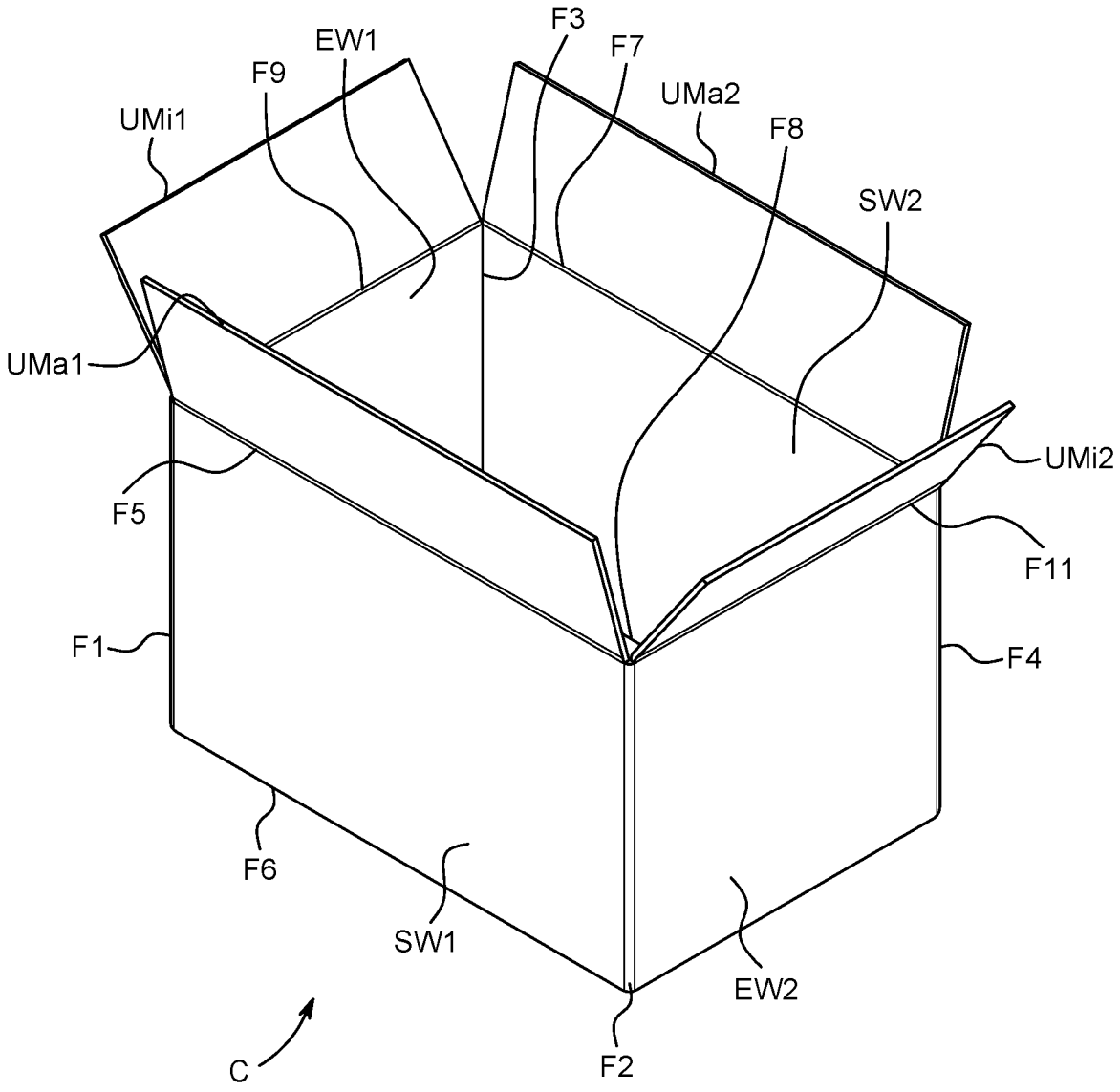
FIG. 1A PRIOR ART
FIG. 1A is a top perspective view of a prior art case having open upper major and minor flaps and closed lower major and minor flaps.
Figure 1B:
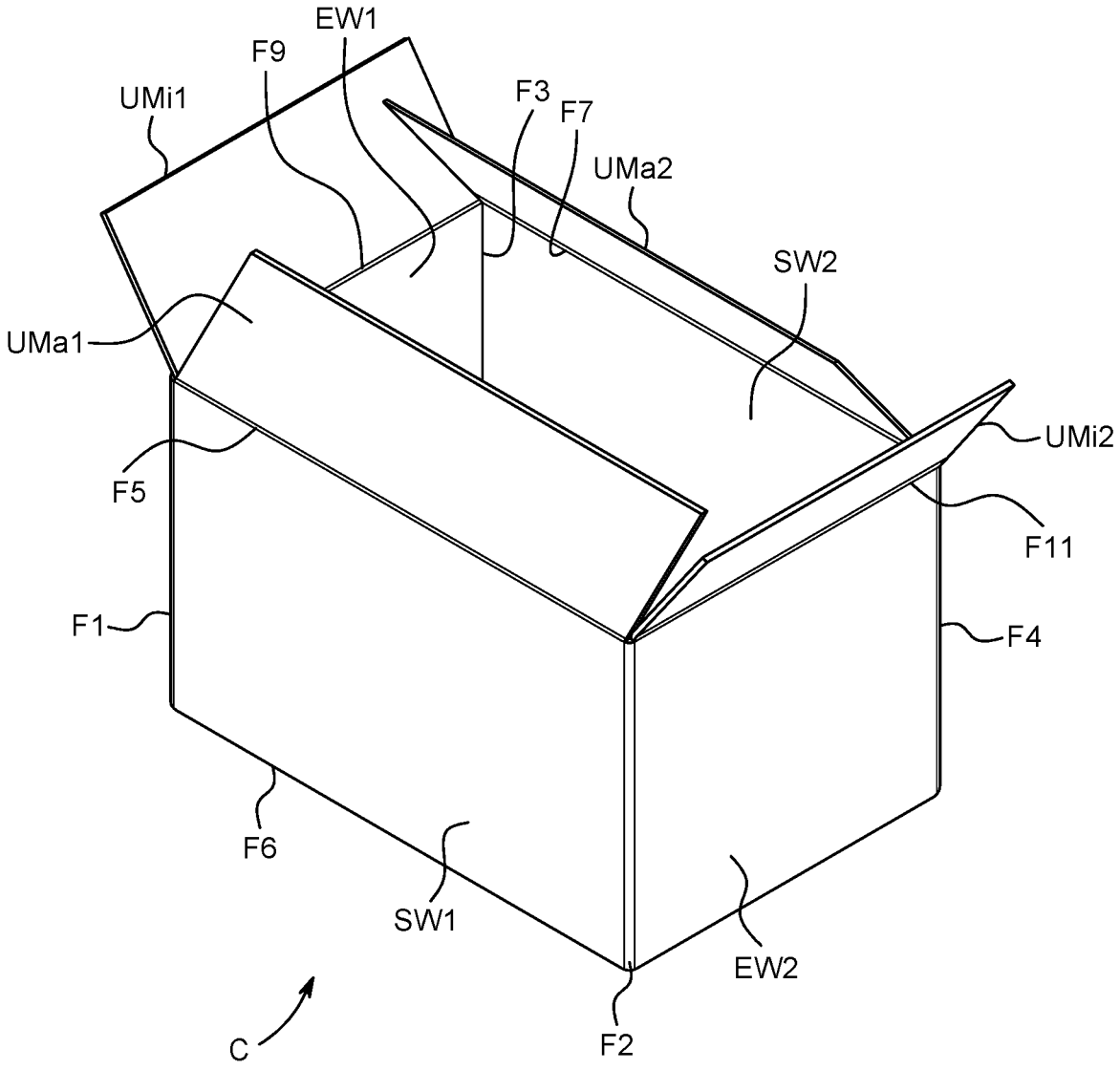
FIG. 1B PRIOR ART
FIG. 1B is a top perspective view of the case of FIG. 1A with the upper major flaps folded inwardly.

While the systems, devices, and methods described herein may be embodied in various forms, the drawings show, and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connection of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, etc., are not intended to be limited to direct mounting methods, but should be interpreted broadly to include indirect and operably coupled, mounted, connected, and like mounting methods. This specification is intended to be taken as a whole and interpreted in accordance with the principles of the present disclosure and as understood by one of ordinary skill in the art.

Various embodiments of the present disclosure provide a case-handling system including movable flap openers positionable relative to a case and operable to fold the upper major flaps of the case outwardly before the upper minor flaps of the case are folded inwardly and closed.

FIGS. 2-7D show one example embodiment of a case-handling system 120 of the present disclosure and components thereof. The case-handling system 120 includes: an infeed conveyor 140, a central conveyor 160, an outfeed conveyor 180, a combined flap closer and case sealer 300, a centering assembly 400, a flap-opener assembly 500, a controller 600, and multiple sensors S.

The conveyors 140, 160, and 180 cooperate to move cases into, through, and out of the case-handling system 120. The infeed conveyor 140 is positioned upstream of the flap closer and case sealer 300, the outfeed conveyor 180 is positioned downstream of the flap closer and case sealer 300, and the central conveyor 160 is between the infeed and outfeed conveyors and below the flap closer and case sealer 300. The infeed and outfeed conveyors 140 and 180 each include a multiple rollers 142 and 182, respectively, that support the cases. The central conveyor 160 includes multiple parallel belts 162 and 164 that support the cases. The rollers 142 and 182 and the belts 162 and 164 are driven in tandem or independently by one or more drive assemblies (not shown) operated under the control of the controller 600.

The infeed conveyor 140 is operable to deliver each case to a case-centering/flap-opening position adjacent the centering assembly 400 and the flap-opener assembly 500. After the upper major flaps of the case have been opened, the conveyor 140 is operable to move the case from that position to the central conveyor 160. The conveyor 160 moves the case below and through the flap closer and case sealer 300 and delivers the case to the outfeed conveyor 180, at which point the minor and major flaps of the case have been closed and sealed. The conveyor 180 moves the case away from the case-handling system 120.

The centering assembly 400 is positioned upstream of the flap closer and case sealer 300 and along the infeed conveyor 140 and is operable to center cases on the infeed conveyor 140. The centering assembly 400 includes first and second centering arms 420*a* and 420*b* and a centering-arm actuator (not shown). The centering arms 420*a* and 420*b* are positioned on opposite sides of the infeed conveyor 140, extend generally parallel to a direction of travel of cases through the case-handling system 20 sealer 10, and are movable laterally inward (relative to the direction of travel) to laterally center the case on the infeed conveyor 140. The centering-arm actuator is operably connected to the first and second centering arms 420*a* and 420*b* (either directly or via suitable linkages) to move the centering arms between: (1) a rest configuration (FIG. 2) in which the centering arms are positioned at or near the lateral extents of the infeed conveyor 140 to enable a case to-be-sealed to be conveyed between centering arms; and (2) a centering configuration (not shown) in which the centering arms (after being moved toward one another) contact the case and center the case on the infeed conveyor 140. The controller 600 is operably connected to the centering-arm actuator to control the centering-arm actuator to move the centering arms 420*a* and 420*b* between the rest and centering configurations. The centering-arm actuator may be any suitable type of actuator, such as a motor or a pneumatic cylinder fed with pressurized gas and controlled by one or more valves.

The flap-opener assembly 500 is positioned upstream of the flap closer and case sealer 300, along the infeed conveyor 140 near its outfeed end, and adjacent the centering assembly 400 and is operable to fold the case's upper major flaps outwardly before the case's upper minor flaps are folded inwardly and closed. The flap-opener assembly 500 includes: first and second flap openers 510*a* and 510*b*; first and second flap-opener supports 555*a* and 555*b* supporting the first and second flap openers 510*a* and 510*b*, respectively; and one or more flap-opener actuators including (but not limited to) first and second rotators 560*a* and 560*b*.

As best shown in FIGS. 5-7D, the first flap opener 510*a* includes: a cylindrical drive shaft 520*a*; a tubular finger support 530*a*; a first set of flap-engaging fingers 540*a*, 542*a*, 544*a*, and 546*a*; and a second set of flap-engaging fingers

550*a*, 552*a*, 554*a*, and 556*a*. The drive shaft 520*a* has a rotational (and longitudinal) axis $A_{510a}$. The finger support 530*a* is fixedly mounted to and circumscribes the drive shaft 520*a* such that the finger support 530*a* and the drive shaft 520*a* are coaxial and both have the rotational axis $A_{510a}$. The first set of flap-engaging fingers 540*a*, 542*a*, 544*a*, and 546*a* are connected to and extend radially outwardly from the finger support 530*a* and are longitudinally aligned with the shared rotational axis $A_{510a}$. The second set of flap-engaging fingers 550*a*, 552*a*, 554*a*, and 556*a* are connected to and extend radially outwardly from the first finger support 530*a* and are longitudinally aligned and spaced-apart along the shared rotational axis $A_{510a}$. The first and second sets of flap-engaging fingers extend in opposite directions from one another such that the flap-engaging fingers 540*a* and 550*a* are generally parallel, the flap-engaging fingers 542*a* and 552*a* are generally parallel, the flap-engaging fingers 544*a* and 554*a* are generally parallel, and the flap-engaging fingers 546*a* and 556*a* are generally parallel. The first and second sets of flap-engaging fingers are fixed in rotation with the finger support 530*a* such that they rotate with the finger support 530*a* and the drive shaft 520*a* about the rotational axis $A_{510a}$, as described below.

Similarly, the second flap opener 510*b* includes: a cylindrical drive shaft 520*b*; a tubular finger support 530*b*; a first set of flap-engaging fingers 540*b*, 542*b*, 544*b*, and 546*b*; and a second set of flap-engaging fingers 550*b*, 552*b*, 554*b*, and 556*b*. The drive shaft 520*b* has a rotational (and longitudinal) axis $A_{510b}$. The finger support 530*b* is fixedly mounted to and circumscribes the drive shaft 520*b* such that the finger support 530*b* and the drive shaft 520*b* are coaxial and both have the rotational axis $A_{510b}$. The first set of flap-engaging fingers 540*b*, 542*b*, 544*b*, and 546*b* are connected to and extend radially outwardly from the finger support 530*b* and are longitudinally aligned with the shared rotational axis $A_{510b}$. The second set of flap-engaging fingers 550*b*, 552*b*, 554*b*, and 556*b* are connected to and extend radially outwardly from the first finger support 530*b* and are longitudinally aligned with and spaced-apart along the shared rotational axis $A_{510b}$. The first and second sets of flap-engaging fingers extend in opposite directions from one another such that the flap-engaging fingers 540*b* and 550*b* are generally parallel, the flap-engaging fingers 542*b* and 552*b* are generally parallel, the flap-engaging fingers 544*b* and 554*b* are generally parallel, and the flap-engaging fingers 546*b* and 556*b* are generally parallel. The first and second sets of flap-engaging fingers are fixed in rotation with the finger support 530*b* such that they rotate with the finger support 530*b* and the drive shaft 520*b* about the rotational axis $A_{510b}$, as described below.

In this example embodiment, the flap-engaging fingers are flexible and, specifically, are formed from individual springs each having a relatively low stiffness and connected at one end of the finger support 530*a*. The flap-engaging fingers may be formed from any suitable flexible material or component(s) in other embodiments, such as brushes or flexible polymeric material. In alternative embodiments, the flap-engaging fingers are rigid and inflexible, and may be formed from any suitable rigid material or component(s), such as metal or inflexible polymeric rods. In this example embodiment, each flap-engaging finger is separate from the other flap-engaging fingers. In other embodiments, each pair of oppositely extending flap-engaging fingers (e.g., flap-engaging fingers 540*a* and 550*a*) is formed from a single component extending through the drive finger support 530*a* and the drive shaft 520*a*. In various embodiments, the flap-engaging fingers of a given set are not longitudinally aligned, but rather are radially spaced as well as longitudinally spaced. In certain such embodiments, are arranged in a helical manner.

In various embodiments, the flap openers are positioned prior to the minor flaps being folded inwards. In various embodiments, the flap openers continually rotating and the flexible fingers facilitate this continual rotations without causing interference with the minor flaps. In various embodiments, the case can be presented in a controlled manner where the fingers are poised to contact the major flaps while avoiding the possibility of contacting the leading and/or trailing minor flaps. In such embodiments, the fingers can be less flexible or solid.

Figure 2:
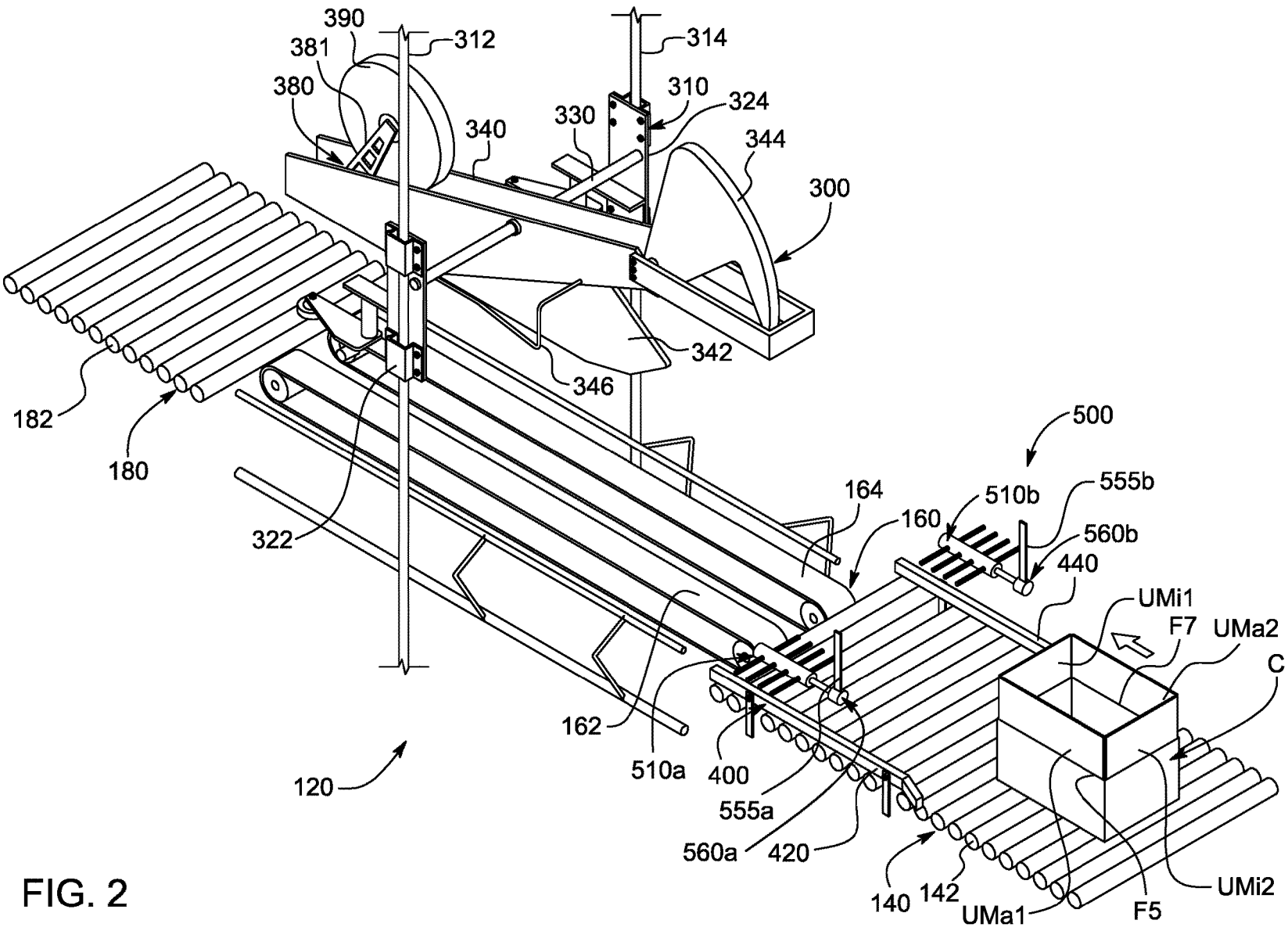
FIG. 2 is a perspective view of an example case-handling system of the present disclosure including two example flap openers of the present disclosure.
Figure 3:
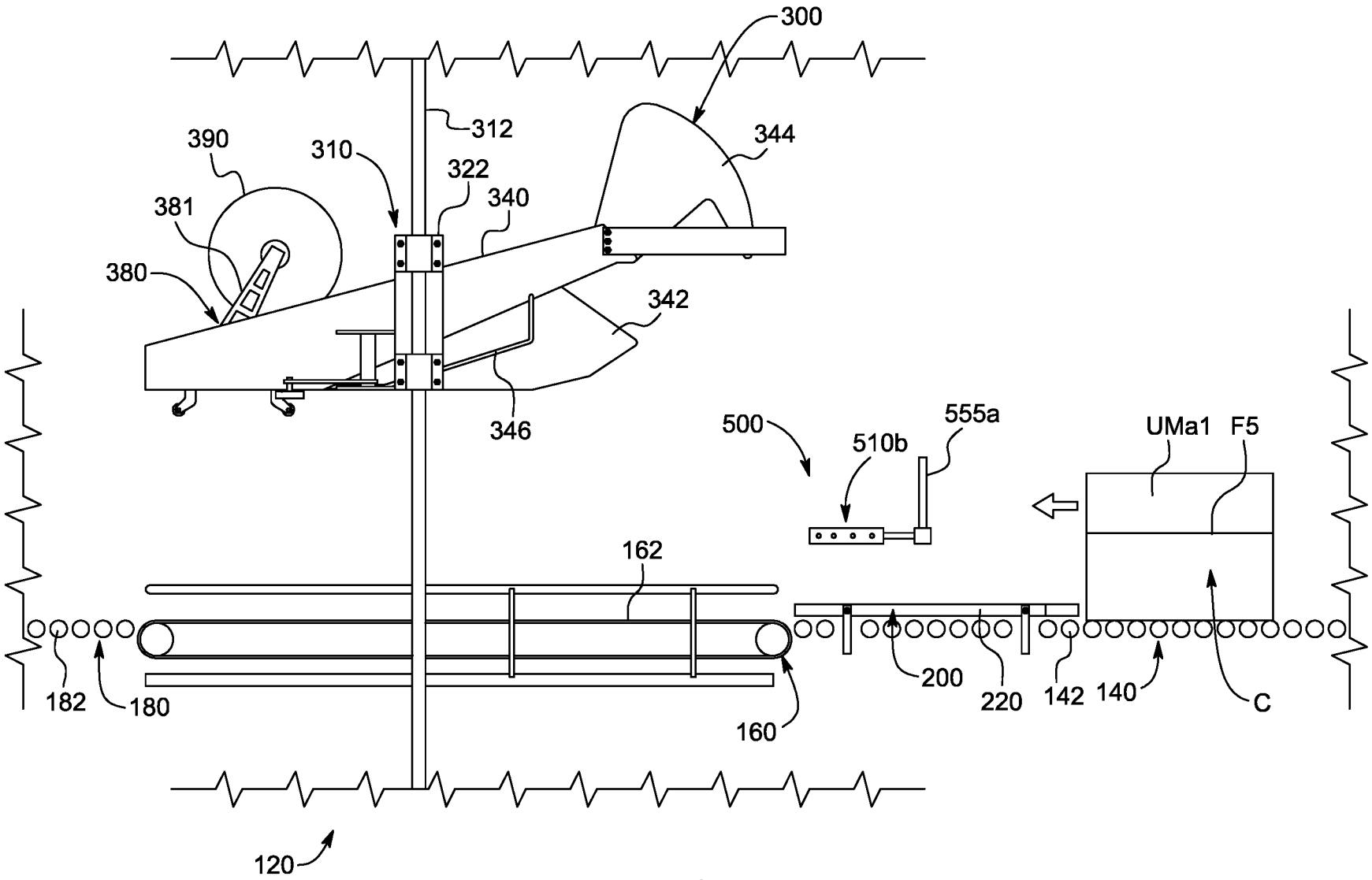
FIG. 3 is a side view of the case-handling system of FIG. 2.
Figure 4:
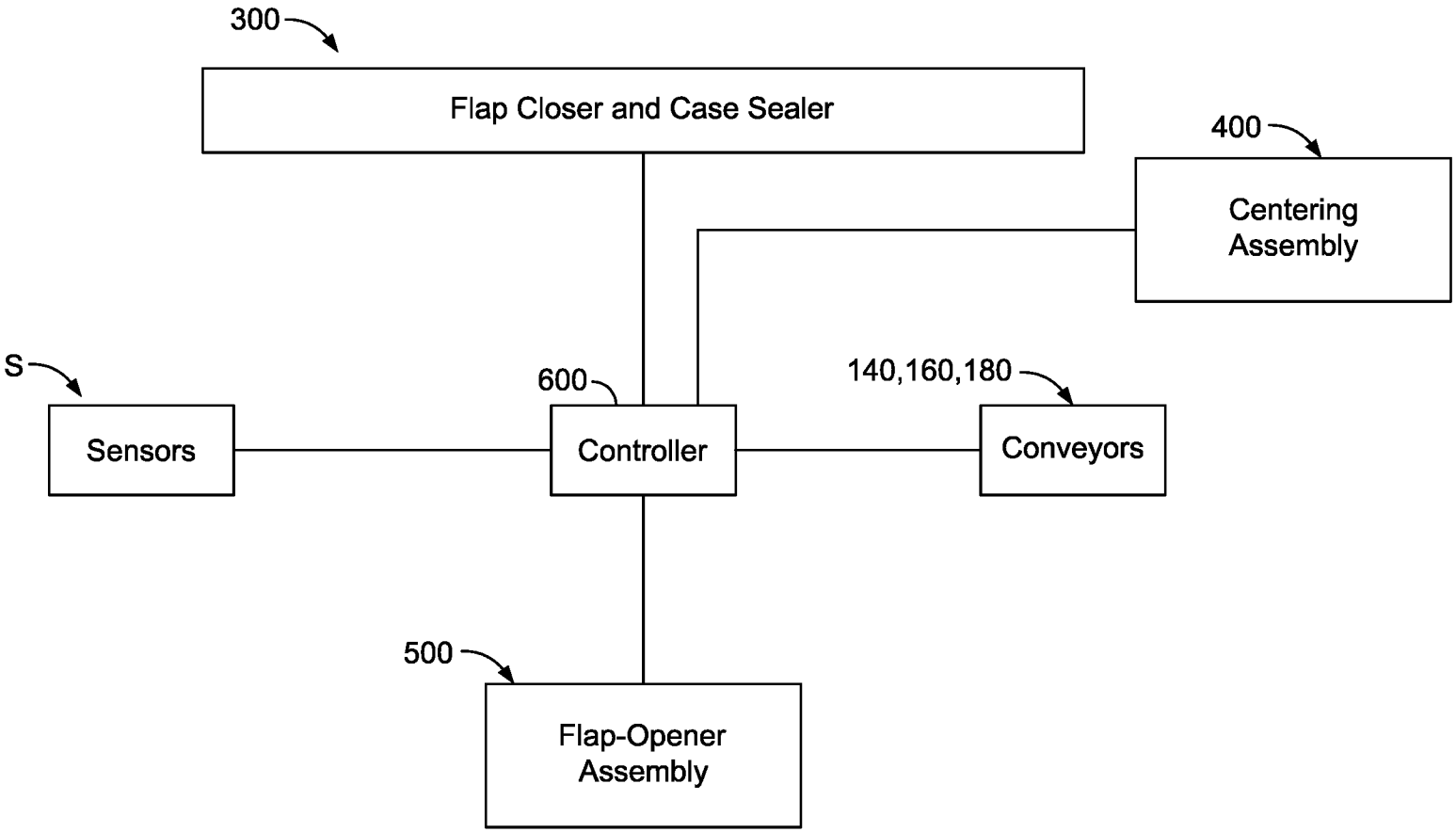
FIG. 4 is a block diagram showing certain components of the case-handling system of FIG. 2.
Figure 5:
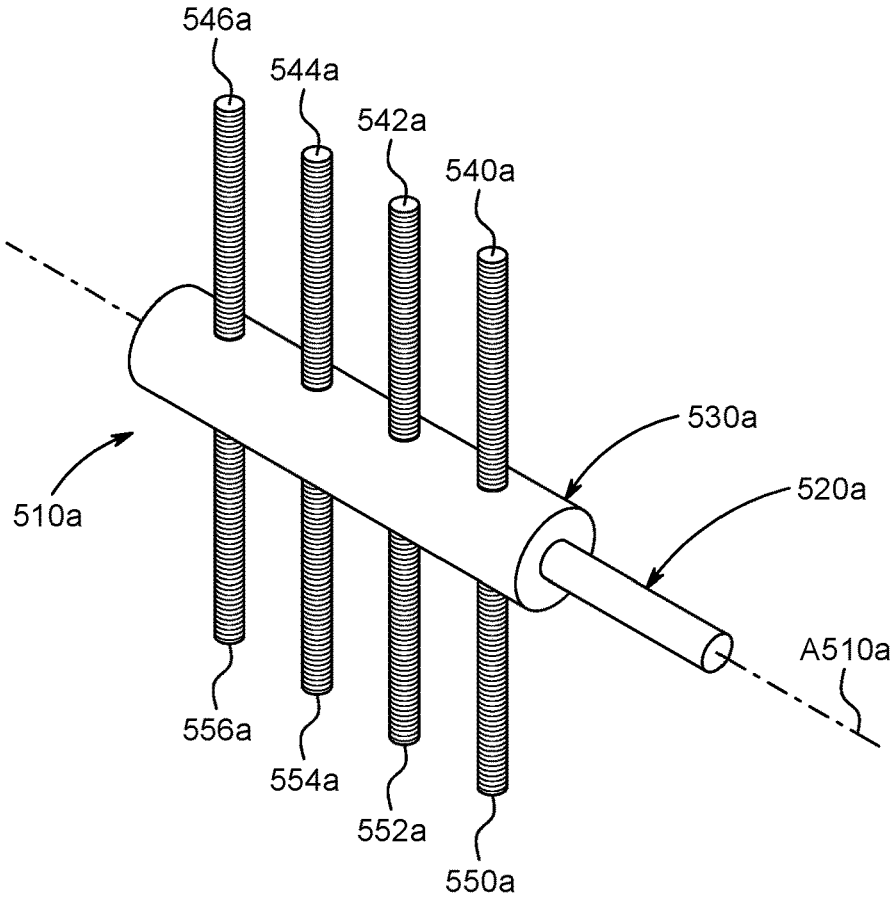
FIG. 5 is a top perspective view of the flap opener of the case-handling system of FIG. 2.
Figure 6:
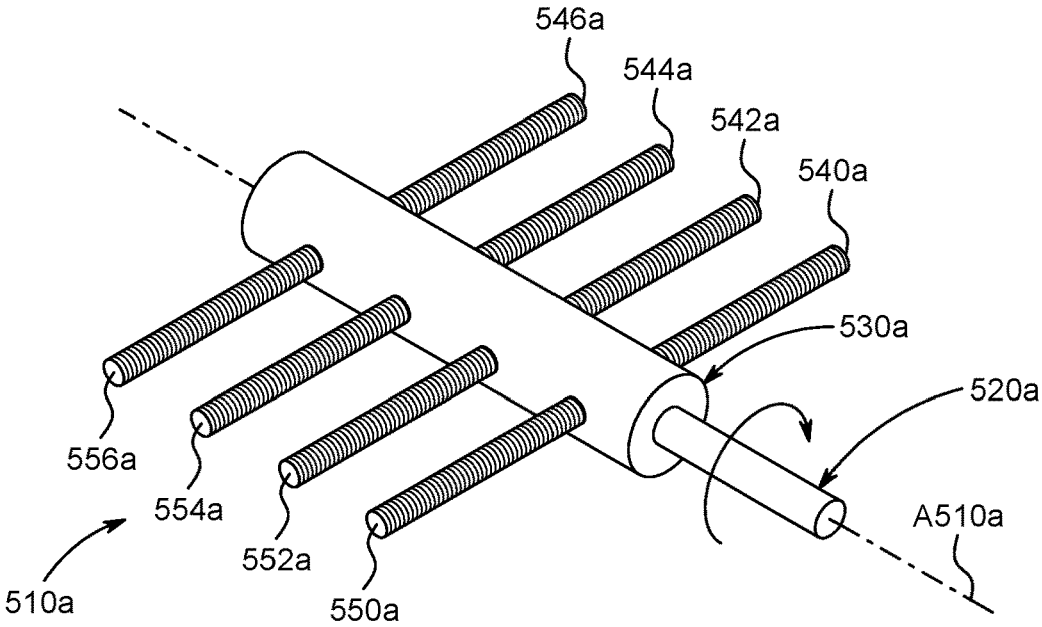
FIG. 6 is a top perspective view of the flap opener of FIG. 5 shown rotated ninety degrees.

As best shown in FIGS. 2 and 6, the first rotator 560*a* is operably connected to the drive shaft 520*a* of the first flap opener 510*a* and configured to rotate the first flap opener 510*a* about the rotational axis $A_{510a}$, and the second rotator 560*b* is operably connected to the drive shaft 520*b* of the second flap opener 510*b* and configured to rotate the second flap opener 510*b* about the rotational axis $A_{510b}$. The rotators rotate the flap openers in opposite rotational directions (here, the first flap opener 510*a* clockwise and the second flap opener 510*b* counter-clockwise when viewed from the infeed side) to ensure they engage and open the upper major flaps as described below. In this example embodiment, supports 555*a* and 555*b* are oriented such that the flap openers 510*a* and 510*b* (and, more particularly, their respective rotational axes $A_{510a}$ and $A_{510b}$) extend generally parallel to a direction of travel of cases through the case-handling system 120 and above the centering arms 420*a* and 420*b*, respectively. The flap-opening actuators are operably connected to the flap openers 510*a* and 510*b* (via the supports 555*a* and 555*b*) to move the flap openers 510*a* and 510*b* laterally inward and outward (relative to the direction of travel of the case) and upward and downward relative to the centering arms 420*a* and 420*b*, the infeed conveyor 140, and the cases. The flap-opener actuators (including the rotators 560*a* and 560*b*) may be any suitable type of actuators, such as motors or pneumatic cylinders fed with pressurized gas and controlled by one or more valves. The controller 600 is operably connected to the flap-opener actuators to control the flap-opener actuators to move the flap openers. Accordingly, in this example embodiment, the flap openers 510*a* and 510*b* are movable relative to cases in rotation, laterally inward and outward, and upward and downward under the control of one or more actuators. In this example embodiment, the flap openers 510*a* and 510*b* are coupled or otherwise configured such that they simultaneously move vertically and laterally, though in other embodiments they are not coupled as such. In other embodiments, the flap openers are attached to and laterally movable with the centering arms of the centering assembly (though they are still movable vertically relative to the centering arms).

As described in more detail below, in operation, the controller 600 controls the appropriate actuators to move the flap openers 510*a* and 510*b* relative to a case C to, as best shown in FIGS. 2, 3, 7A, 7B, 7C, and 7D: (1) a vertical position at which the vertical distance between the infeed conveyor 140*a* and the rotational axes $A_{510a}$ and $A_{510b}$ is greater than the combined height of one of the side walls and one of the upper major flaps (when oriented vertically) of the case C; and (2) a lateral position at which the flap-engaging fingers of the flap openers 510*a* and 510*b* can engage the upper major flaps of the case when those flaps are greater than 45 degrees from horizontal. This positioning not only ensures that the flap openers 510*a* and 510*b* can engage the upper major flaps, but also ensures that there's enough clearance beneath the flap openers 510*a* and 510*b* for the flaps to pass below the flap openers when being folded outwardly. Additionally, the flap openers 510*a* and 510*b* are positioned to engage the case after the centering assembly has centered the case and is holding the case in the center of the infeed conveyor. In various embodiments, the case is thus centered before the flap openers contact the upper major flaps. In various embodiments, the case continues to move after centering and while the flap openers engage and open the upper major flaps. In various embodiments, the controller can vary the speed of movement of the case as the upper major flaps are engaged by the fingers of the flap openers. The exact positions of the flap openers will therefore vary based on the size of the case and the length of the flap-engaging fingers and other such options. For instance, in different embodiments and circumstances, the flap folders—and more particularly, their rotational axes—may be laterally positioned directly above the upper major fold lines, laterally outward of the upper major fold lines, or laterally inward of the upper major fold lines.

Each flap opener has a suitable length relative to the lengths of the upper major flaps of the cases that will be processed by the case-handling system such that the flap openers can apply sufficient repeated forces against the inner surfaces of the upper major flaps at one or more positions of the case as the case is moved downstream to ensure that the upper major flaps are sufficiently opened. The quantity of fingers and the length of the flap openers can vary, and in various different embodiments, each flap opener can be longer than the length of the longest case that the case sealer will process, equal to the length of the longest case that the case sealer will process, or shorter than the length of the longest case that the case sealer will process.

The combined flap closer and case sealer 300 is operable to close the upper minor flaps of a case, then close the upper major flaps of the case, and then apply tape to the closed upper and lower major flaps. The combined flap closer and case sealer 300 includes a carriage 310 supported by and vertically movable relative to spaced-apart supports 312 and 314. The carriage 310 includes slide plates 322 and 324, a crossbar 330 attached to and extending between the slide plates 322 and 324, and an elongated support 340 attached to the crossbar 330. The slide plates 322 and 324 are slidably mounted to the supports 312 and 314. A carriage actuator (not shown) is operably connected to the carriage 310 and configured to move the carriage 310 vertically to adapt to cases of different heights. The controller 600 is operably connected to and configured to control the carriage actuator.

The support member 340 supports a stationary leading minor flap closer 342, a movable trailing minor flap closer 344, a first major flap closer 346, and a second major flap closer (not shown). More specifically, the stationary leading minor flap closer 342 extends downward from an underside of the support 340 and positioned, shaped, oriented, and otherwise is configured to engage the leading surface of the first upper minor flap UMi1 of a case C as central conveyor 160 moves the case C into contact with the stationary leading minor flap closer 342. Continued movement of the case C past the stationary leading minor flap closer 342 results in the first upper minor flap UMi1 closing. The movable trailing minor flap closer 344 pivotably attached to the support 340 and configured to pivot downwardly (via a minor-flap-closer actuator (not shown) controlled by the controller 600) to engage and close the second upper minor flap UMi2 of the case C as the case moves under the combined flap closer and case sealer 300. The first and second major flap closers are positioned on opposite sides of the leading minor flap closer 342 and are positioned, shaped, oriented, and otherwise configured to engage and close the upper major flaps UMa1 and UMa2 of the case C as the central conveyor 160 moves the case C into contact with and past the major flap closers.

The flap closer and case sealer 300 also includes a tape applicator 380 that includes a tape cartridge 381 (partially shown) supporting a roll of tape 390. The tape applicator 380 is configured to apply tape from the roll 390 to the closed upper major flaps UMa1 and UMa2 and minor side walls of the case as the central conveyor 160 moves the case C beneath and past the tape cartridge 381.

The controller 600 controls, communicates with, and operates with the components of the case-handling system 120, including various actuators, drive assemblies, and sensors referenced above. The controller 600 is configured to control movement or operation of at least part of the conveyors, the combined flap closer and case sealer 300, the centering assembly 400, and the flap-opener assembly 500. The controller 600 can be any suitable type of controller (such as a programmable logic controller) that includes any suitable processing device(s) (such as a microprocessor, a microcontroller-based platform, an integrated circuit, or an application-specific integrated circuit) and any suitable memory device(s) (such as random-access memory, read-only memory, or flash memory). The memory device(s) stores instructions executable by the processing device(s) to control operation of the case-handling system 120.

Figure 7A:
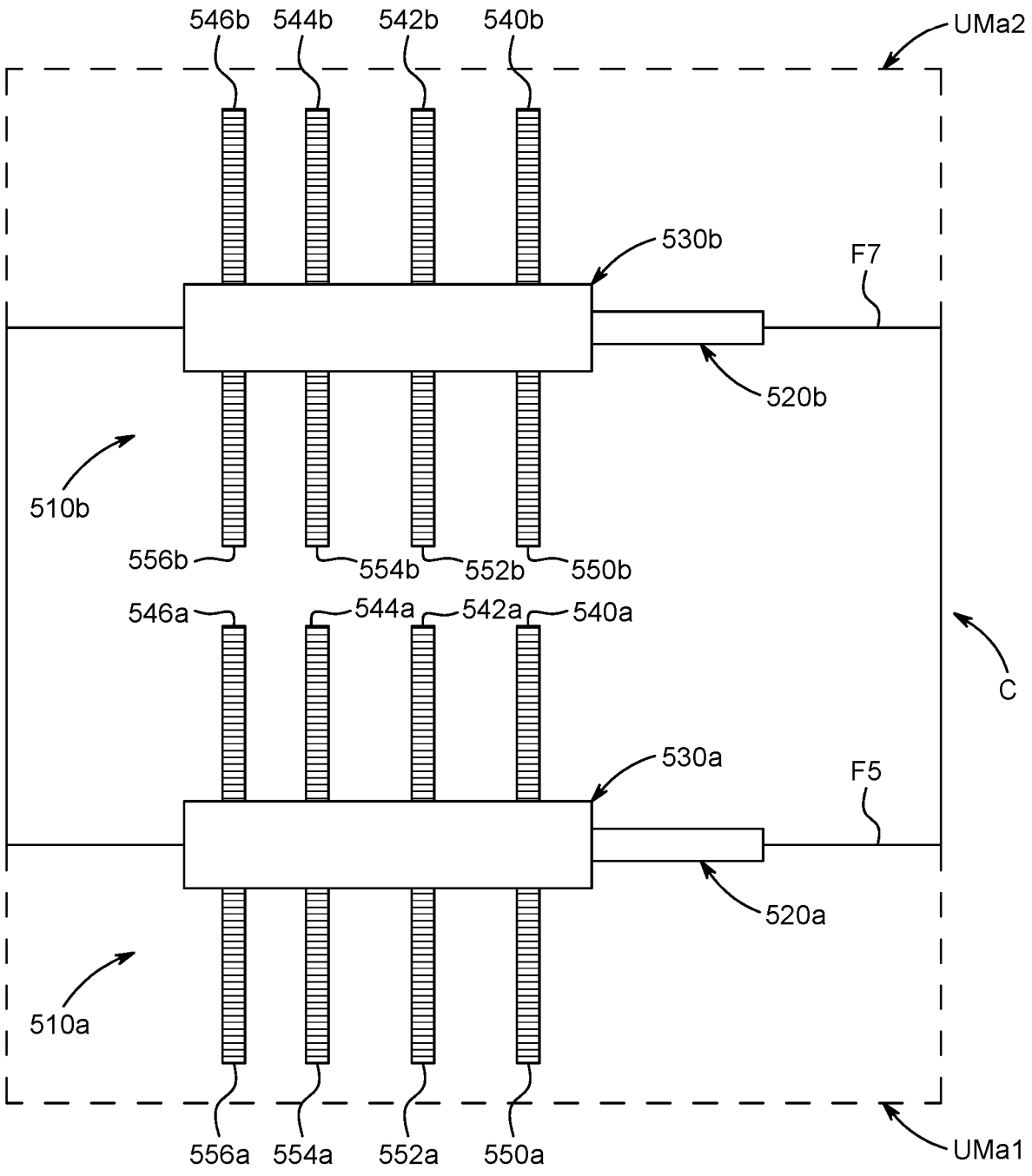
FIG. 7A is a top view of the flap openers of FIG. 2 positioned above a case such that the flap openers are positioned to open the upper major flaps of the case.
Figure 7B:
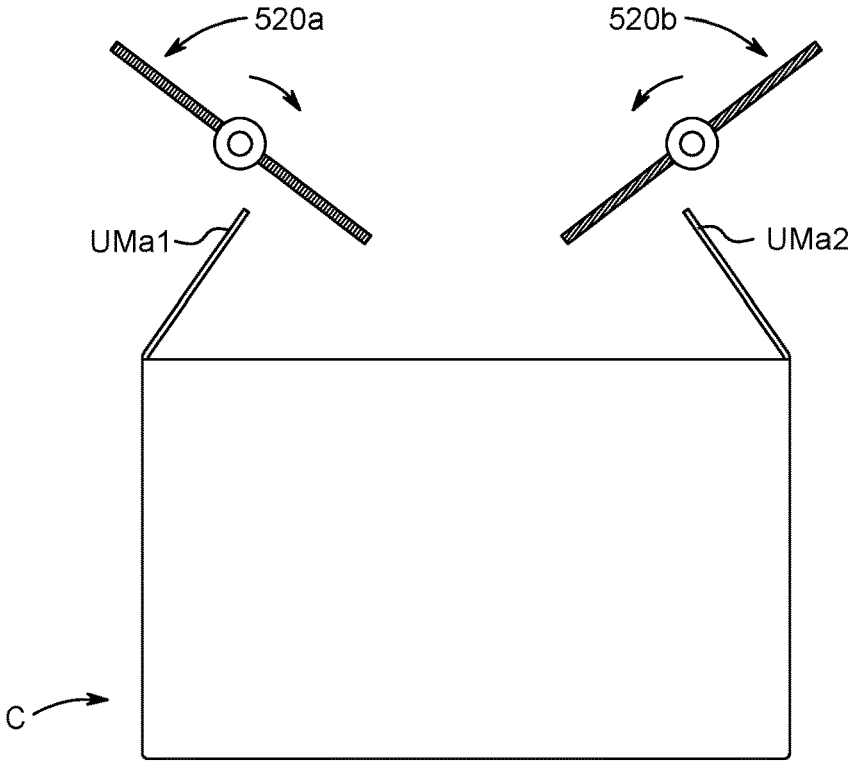
FIGS. 7B, 7C, and 7D are end views of the flap openers of FIG. 2 positioned above a case and the flap openers rotating in opposite directions showing the progression of the opening of the upper major flaps of the case.
Figure 7C:
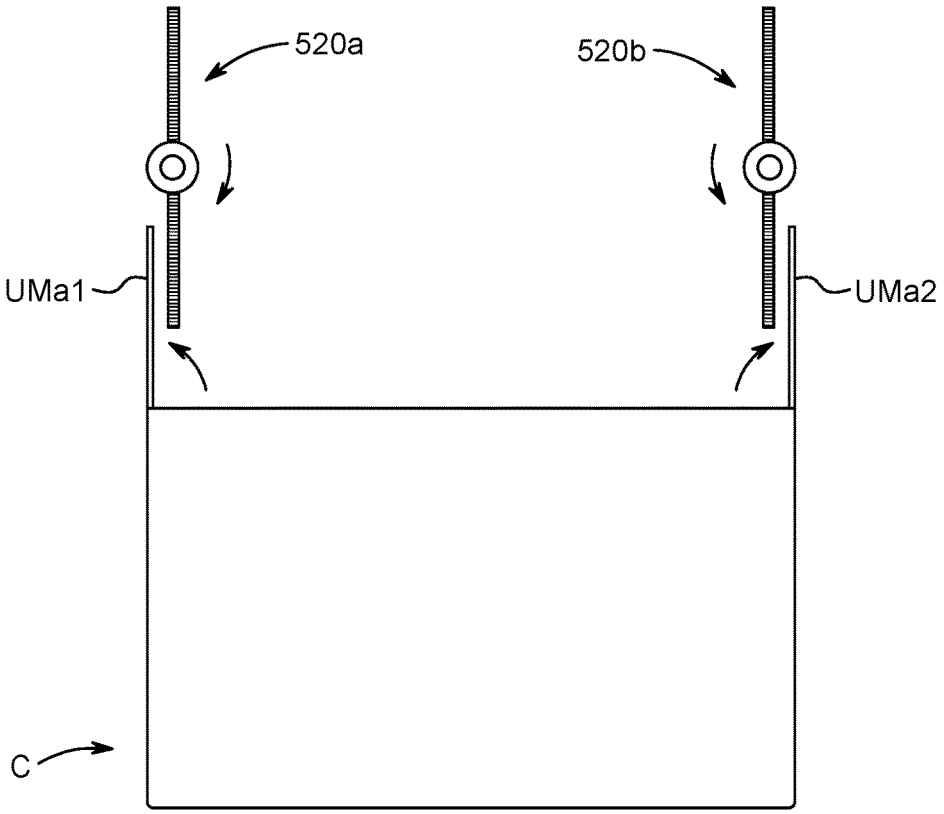
Figure 7D:
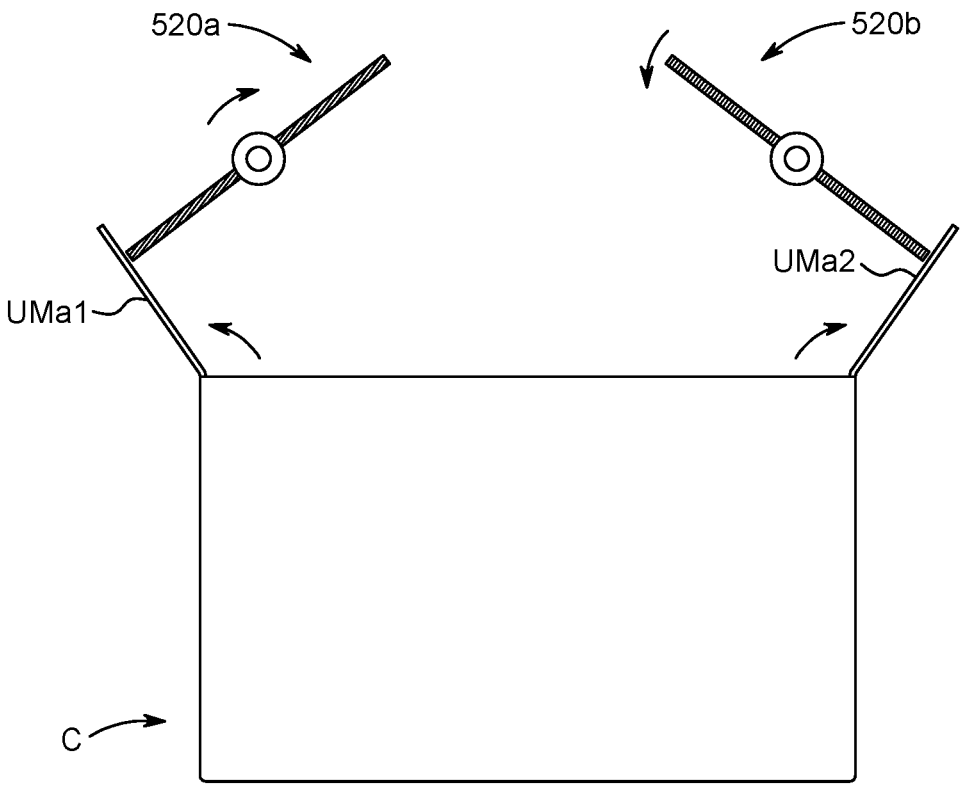

In operation, the controller 600 controls the infeed conveyor 140 to move a case C toward the flap closer and case sealer 300. When the case C is between the centering arms 420*a* and 420*b* of the centering assembly 400, one of the sensors S (such as a photocell) is triggered. This causes the controller 600 to: stop the infeed conveyor 140 and move the centering arms 420*a* and 420*b* laterally inwardly to center the case C on the infeed conveyor 140. The controller 600 also controls the flap-opener actuators to move the flap openers 510*a* and 510*b* to their respective flap-opening positions and to begin rotating the flap openers. After the case C is centered and before the centering arms 420*a* and 420*b* return to their rest configuration, the controller 600 controls the infeed conveyor 140 to continue moving the case C. Continued movement of the case C causes the case C to pass between the flap openers 510*a* and 510*b*. If the upper major flaps of the case C are folded inwardly, the flap-engaging fingers of the flap openers 510*a* and 510*b* engage the inner surfaces of the flaps and fold the flaps outward, as shown in FIGS. 7B, 7C, and 7D. Eventually, the case moves onto the central conveyor 60, and the beneath the flap closer and case sealer 300, which closes the upper minor and major flaps and tapes them shut, as explained above. In this example embodiment, the flap openers 510*a* and 510*b* continue engaging the upper major flaps of the case C as the flap closer and case sealer 300 begins folding the leading upper minor flap. Additionally, in this example embodiment, the case C does not stop moving while it passes through the flap openers 510*a* and 510*b*, though it may stop moving in other embodiments.

The controller 600 determines the proper position of the flap openers based on the size of the case (e.g., its height and width) and the size of the flap opener (e.g., the length of the flap-engaging fingers). In certain embodiments, one or more of the sensors S detect the height, width, and/or other measurements of the case upstream of the flap-opener assembly, and the controller determines where to position the flap openers based on those measurements. In other embodiments, the controller receives the measurements from another component in the packaging line. In further embodiments, the controller receives instructions as to where to position the flap openers from another component in the packaging line.

As noted above, in this example embodiment, the flap-engaging fingers are flexible. The flexible flap-engaging fingers engage and apply outward forces to the inner surfaces of the upper major flaps to fold (pivot) the upper major flaps outwardly along their respective fold lines. As they apply this force, they may bend so as not apply too much force to the upper major flap and, therefore, not damage the upper major flap by such engagement. After engaging the upper major flap and applying such outward forces to the upper major flap, each flexible flap-engaging finger disengages the upper major flap and returns to its resting position shown in FIGS. 2 and 3.

In this example embodiment, the sets of flap-engaging fingers extend in opposite directions from the finger support such that every half rotation of the finger support can cause one of the sets of fingers (or a subset thereof) to engage an upper major flap. The longitudinal spacing of the flap-engaging fingers is set such that if they engage either of the upper minor flaps, the upper minor flaps can extend through those spaces or cause the flap-engaging fingers to bend, meaning that the flap opener will not substantially change the positions of such upper minor flaps.

The present disclosure provides method for closing and sealing cases of different sizes using a single case-handling system that ensures the upper major flaps are opened before the upper minor flaps are closed.

The invention claimed is:

1. A case-handling system comprising:

a conveyor;

a rotatable first flap opener comprising a first set of multiple spaced-apart flap-engaging fingers;

a rotatable second flap opener spaced apart from the first flap opener and comprising a first set of multiple spaced-apart flap-engaging fingers;

one or more actuators operably connected to the first and second flap openers and configured to rotate the first and second flap openers in opposing rotational directions; and a controller operably connected to the conveyor to drive the conveyor and to the one or more actuators to rotate the first and second flap openers, wherein the first and second flap openers are positionable such that, when a case having first and second upper major flaps and first and second upper minor flaps is conveyed by the conveyor between and past the first and second flap openers:

the first flap opener engages an inner surface of the first upper major flap to fold the first upper major flap outwardly, and the second flap opener engages an inner surface of the second upper major flap to fold the second upper major flap outwardly.

2. The case-handling system of claim 1, wherein the first flap opener comprises a first drive shaft and wherein one or more of the first set of flap-engaging fingers of the first flap opener extends radially outward from the first drive shaft and are fixed in rotation with the first drive shaft.

3. The case-handling system of claim 2, wherein the first flap opener further comprises a finger support mounted to the first drive shaft and fixed in rotation with the first drive shaft, wherein one end of each of the first set of flap-engaging fingers of the first flap opener is fixed to the finger support.

4. The case-handling system of claim 2, wherein each of the first set of flap-engaging fingers of the first flap opener extends radially outward from the first drive shaft, wherein the first flap opener further comprises a second set of multiple spaced-apart flap-engaging fingers extending radially outward from the first drive shaft, wherein the first and second sets of flap-engaging fingers of the first flap opener extend in opposite directions from the first drive shaft.

5. The case-handling system of claim 1, wherein the one or more actuators are further configured to vertically move the first and second flap openers.

6. The case-handling system of claim 5, wherein the one or more actuators are further configured to laterally move the first and second flap openers.

7. The case-handling system of claim 1, wherein the first and second flap openers are positionable such that, while the case is being conveyed by the conveyor between and past the first and second flap openers:

the first flap opener engages and disengages the inner surface of the first upper major flap more than once to fold the first upper major flap outwardly, and the second flap opener engages and disengages the inner surface of the second upper major flap more than once to fold the second upper major flap outwardly.

8. The case-handling system of claim 1, wherein the controller is configured to control the one or more actuators to begin rotating the first and second flap openers while the case is upstream of the first and second flap openers.

9. The case-handling system of claim 1, wherein the first and second flap openers are sized and positionable such that, while the case is being conveyed by the conveyor between and past the first and second flap openers:

the first flap opener engages the inner surface of the first upper major flap to fold the first upper major flap outwardly without engaging the first and second upper minor flaps, and the second flap opener engages the inner surface of the second upper major flap to fold the second upper major flap outwardly without engaging the first and second upper minor flaps.

10. The case-handling system of claim 1, further comprising a flap closer downstream of the first and second flap and configured to fold the first and second upper minor flaps closed, wherein the first and second flap openers are sized and positionable such that the flap closer begins folding the first upper minor flap closed while the first and second flap openers engage the inner surfaces of the first and second upper major flaps, respectively.

11. The case-handling system of claim 1, wherein one or more of the flap-engaging fingers are flexible.

12. The case-handling system of claim 11, wherein one of the one or more flap-engaging fingers comprises a spring.

13. The case-handling system of claim 1, wherein the first set of flap-engaging fingers of the first flap opener are longitudinally aligned.

* * * * *